US006276451B1

(12) United States Patent
Funk

(10) Patent No.: US 6,276,451 B1
(45) Date of Patent: Aug. 21, 2001

(54) PRESSURE RELIEF SYSTEM FOR LIVE WELL SNUBBING

(76) Inventor: Kelly Funk, 301 Mount Royal Place, Nanaimo, British Columbia (CA), V9R 6A4

( * ) Notice: Subject to any disclaimer, the term of this patent is extended or adjusted under 35 U.S.C. 154(b) by 0 days.

(21) Appl. No.: 09/563,925

(22) Filed: May 4, 2000

(51) Int. Cl.[7] ..... E21B 33/06; E21B 34/02

(52) U.S. Cl. ..... 166/85.4; 166/77.1; 166/91.1; 166/97.1

(58) Field of Search ..... 166/53, 77.1, 85.4, 166/91.1, 97.1, 363, 364

(56) References Cited

U.S. PATENT DOCUMENTS 1,836,508 * 12/1931 Rasmussen ..... 166/85.4 X
3,207,221 * 9/1965 Cochran et al. ..... 166/85.4
3,338,302 * 8/1967 Hubby ..... 166/363 X
3,457,991 * 7/1969 Sizer et al. ..... 166/363
3,589,667 * 6/1971 Lewis et al. ..... 166/97.1
3,637,009 * 1/1972 James ..... 166/77.1 X
3,804,175 * 4/1974 Miller ..... 166/363 X
4,046,191 * 9/1977 Neath ..... 166/363 X
4,440,232 * 4/1984 LeMoine ..... 166/53 X

* cited by examiner

*Primary Examiner*—George Suchfield

(57) ABSTRACT

A pressure relief system for use in live well snubbing has blow-out preventers (BOPs) mounted one above the other in a BOP stack on a live well bore and spools installed between successive ones of the blow-out preventers, the spools and the blow-out preventers being arranged along a passage communicating with the well bore and serving to receive piping therethrough during snubbing operations. Supply ducts communicating with the passage between successive ones of the blow-out preventers are provided with gas pressure regulators.

6 Claims, 1 Drawing Sheet

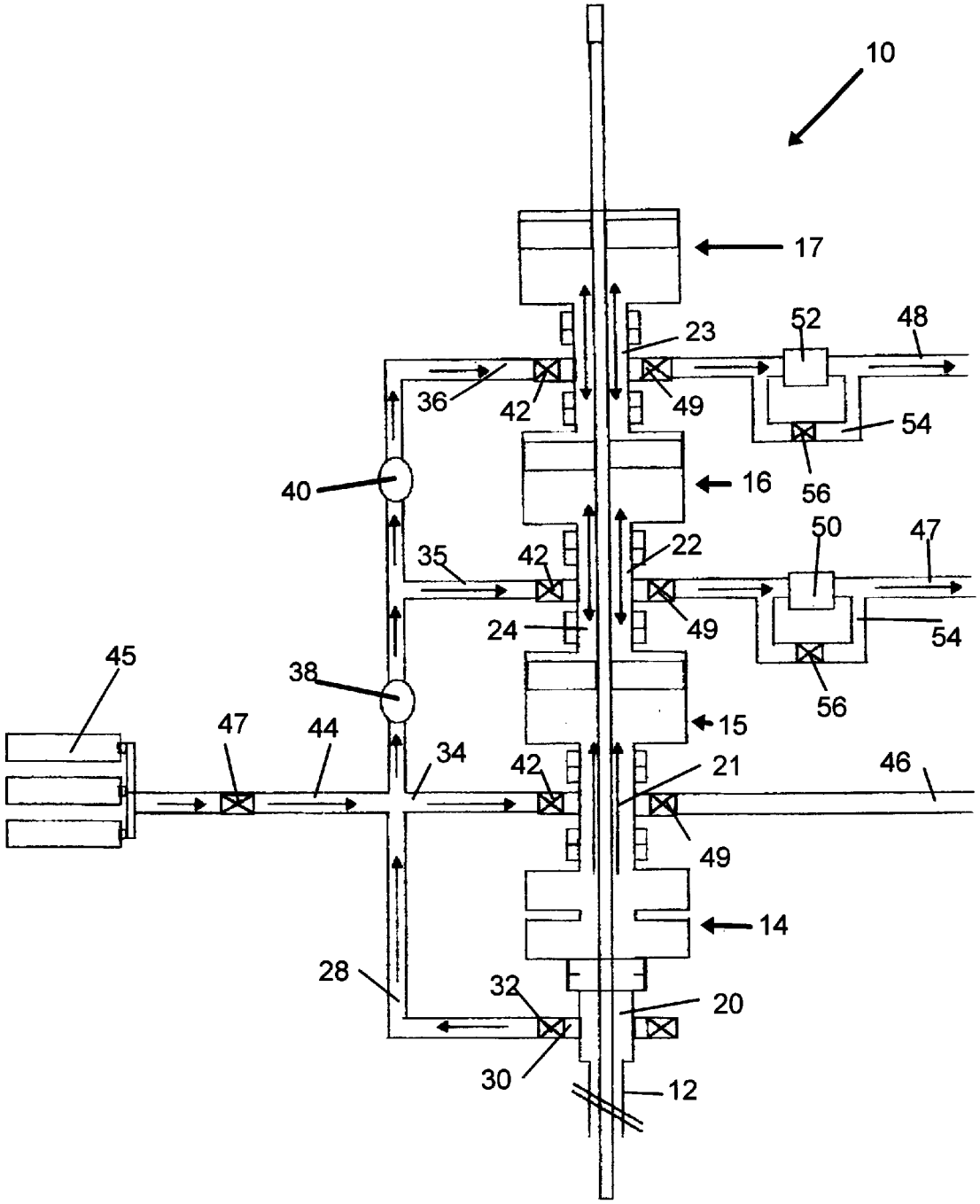
10
17
23
52
48
36
42
49
54
40
16
56
50
47
35
42
22
24
49
54
45
38
56
47
44
15
34
42
21
46
49
14
28
32
20
30
12

PRESSURE RELIEF SYSTEM FOR LIVE WELL SNUBBING

BACKGROUND OF THE INVENTION

1. Field of the Invention

The present invention relates to a pressure relief system for use in live well snubbing.

2. Description of the Related Art

For the insertion of piping and tools into live well bores, and the extraction of piping and tools from live well bores, known as "snubbing", it is conventional to employ a snubbing unit provided with one or more blow-out preventers (BOPs), which are closed into pressuretight engagement with the piping in order to prevent leakage of gas under pressure from the well bore.

During conventional snubbing operations, it is considered standard procedure to operate at the available surface pressure. For example, for a well having 4,500 psi surface pressure, then this pressure would typically be consistently maintained at the uppermost blow-out preventer while performing snubbing or stripping operations through annular BOPs.

The present invention is based on the concept that it would be desirable to reduce the pressure between the well bore and the apparatus employed for snubbing, thereby reducing unnecessary risks and improving the safety of what would otherwise normally be considered to be a very hazardous operation, i.e. moving pipe through blow-out preventers at a pressure differential of 4,500 psi

BRIEF SUMMARY OF THE INVENTION

According to the present invention, there is provided a pressure relief system for use in live well snubbing, between the well bore and an overlying snubbing installation, which comprises a plurality of blow-out preventers mounted one above the other on the well bore, with a plurality of spools installed between successive ones of the blow-out preventers, the spools and the blow-out preventers being arranged along a passage communicating with the well bore and serving to receive piping therethrough during snubbing operations. Gas supply ducts communicate with the passage between successive ones of the blow-out preventers and are provided with gas pressure regulators, so that the pressure in the passage progressively increases along the passage in an upward direction.

In a preferred embodiment of the invention, pressure bleed-off ducts communicate with the passage between the blow-out preventers and are provided with pressure relief valves for limiting the pressures in the passage between successive ones of the blow-out preventers.

BRIEF DESCRIPTION OF THE DRAWING

The invention will be more readily understood from the following description of a preferred embodiment thereof given, by way of example, with reference to the accompanying diagrammatic drawing, which illustrates a pressure relief system according to the present invention.

DESCRIPTION OF THE PREFERRED EMBODIMENT

In the accompanying drawing, there is provided a pressure relief system indicated generally by reference numeral 10 which is arranged on a well bore 12 and which comprises a plurality of blow-out preventers indicated generally by reference numerals 14 through 17.

The blow-out preventers 14 through 17 are mounted one above the other, with the lowest blow-out preventer 14 supported on a well head casing 20.

Spools 21 through 23 are provided between the blow-out preventers 14 through 17 and, together with the blow-out preventers 14 through 17, form a passage 24 through which piping (not shown) can be fed into and from the well bore 12 during snubbing operations.

A first gas supply duct 28 has an inlet end 30 provided with a shut-off valve 32 and communicates through the inlet ends of gas supply ducts 34,35 and 36 with the passage 24, at the spools 21, 22 and 23, respectively, i.e. between successive ones of the blow-out preventers 14 through 17. The duct 28 is provided with a first pressure regulator 38, between the ducts 34 and 35, and a second pressure regulator 40, between the ducts 35 and 36.

Each of the ducts 34 through 36 is also provided, at its outlet end, with a gas shut-off valve 42.

A further gas supply duct 44, which is connected to a compressed gas source, e.g. one or more compressed gas cylinders or a compressor, may be provided for supplying gas under pressure into the duct 28 and through the ducts 34, 35 and 36 to the passage 24. This compressed gas source and the duct 44 may, however, be omitted or, alternatively, may be provided instead of the connection to the well bore through the duct 28.

The spools 21,22 and 23 are also each provided with a respective pressure bleed-off duct 46, 47 or 48, each of which is provided at its inlet end with a gas shut-off valve 49.

The bleed-off ducts 47 and 48 are also provided with respective pressure reliefvalves 50 and 52, and with bypass ducts 54, which bypass the pressure relief valves 50 and 52 and which are provided with gas shut-off valves 56.

In operation of this pressure control system, gas under pressure is supplied through the duct 28 from the well bore 12, and/or through the duct 44 from the compressed gas source, to the gas supply ducts 34, 35 and 36. If, for example, the gas supply duct 34 supplies gas at a pressure of 4,500 psi into the passage 24 at the casing 21, i.e. between the blow-out preventers 14 and 15, then the pressure regulator 38 may be set so that the duct 35 provides gas at a pressure of 3,000 psi into the casing 22 between the blow-out preventers 15 and 16, and so that the duct 36 supplies gas at a pressure of 1,500 psi into the casing 23 between blow-out preventers 16 and 17.

Consequently, as will be apparent, the pressure from the well bore which acts on the snubbing installation overlying the pressure control system 10 is reduced from 4,500 psi to 1,500 psi By this means, any desired working or surface pressure can be achieved in order to enable the piping to be safely moved through the blow-out preventers of the snubbing installation while maintaining the well pressure in the well bore 12.

With this arrangement, the effective well pressure at the uppermost BOP 17 is reduced but the forces resulting from the well pressure acting across the cross-sectional area of the pipe remain the same.

In general, it is not recommended to move or strip pipe repeatedly through annular BOPs above 2,500 psi It is also not recommended to maintain more than 2000 psi differential pressure between annular BOPs as the effects of the topside differential can affect the closing and opening of the BOPs. Too great a pressure above works against the cross-sectional area of the piston that hydraulically forces or releases the annular BOPs into closed or open positions, respectively.

The regulators 50 and 52 are set at a pressure slightly higher than the regulators 38 and 40 so as to maintain a consistent pressure between successive BOPs. Any undesired increase in pressure is vented through ducts 47 and 48 by the pressure relief valves 50 and 52.

The by-pass ducts 54 and valves 56 allow pressure to be selectively discharged when required.

During such venting, the valve 32 is closed and the valves 49 and 56 are open As will be apparent to those skilled in the art, by adding additional spools, valves, BOPs, regulators and reliefvalves and appropriately adjusting the working pressures of the pressure regulators and pressure relief valves, other differential pressure reliefs for servicing of the live well bore 12 can readily be achieved.

I claim:

1. A pressure relief system for use in live well snubbing, comprising:

a plurality of blow-out preventers (BOPS) mounted one above the other in a BOP stack on a live well bore;

a plurality of spools installed between successive ones of said blow-out preventers;

said spools and said blow-out preventers being arranged along a passage communicating with the well bore, the passage serving to receive piping therethrough during snubbing operations;

a plurality of gas supply ducts communicating with said passage between successive ones of said blow-out preventers; and gas pressure regulators in said gas supply ducts.

2. A pressure relief system as claimed in claim 1, further comprising pressure bleed-off ducts communicating with said passage between said blow-out preventers, said pressure bleed-off ducts being provided with pressure relief valves.

3. A pressure relief system as claimed in claim 2, further comprising bypass ducts communicating with said pressure bleed-off ducts, said bypass ducts being provided with gas valves.

4. A pressure relief system as claimed in claim 1, wherein said gas supply ducts have inlet ends connected to said well bore.

5. A pressure relief system as claimed in claim 1, further comprising a compressed gas source separate from said well bore, said gas supply ducts having inlet ends connected to said compressed gas source.

6. A pressure relief system as claimed in claim 1, wherein said gas supply ducts are each provided with a gas shut-off valve.

* * * * *